US006443062B2

(12) United States Patent
Ziegler et al.

(10) Patent No.: US 6,443,062 B2
(45) **Date of Patent: *Sep. 3, 2002**

(54) PADDLE-WHEEL DELIVERER

(75) Inventors: Jürgen Ziegler, Gersthofen; Franz Rumesz, Augsburg, both of (DE)

(73) Assignee: MAN Roland Druckmaschinen AG, Offenbach am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/550,434

(22) Filed: Apr. 17, 2000

(30) Foreign Application Priority Data

Apr. 15, 1999 (DE) ..... 199 17 118

(51) Int. Cl.[7] ..... B41F 3/04
(52) U.S. Cl. ..... 101/272; 271/187
(58) Field of Search ..... 101/272, 266, 101/269, 219, 228; 271/182, 187, 315, 314

(56) References Cited

U.S. PATENT DOCUMENTS 4,017,066 A * 4/1977 Lasher et al. ..... 271/80
4,357,126 A * 11/1982 Kidd et al. ..... 414/46
4,431,178 A * 2/1984 Kokubo et al. ..... 271/187
4,475,733 A * 10/1984 Benson ..... 271/120
4,618,302 A * 10/1986 Kobubo et al. ..... 414/33
4,715,594 A * 12/1987 Isobe et al. ..... 271/65
4,886,260 A 12/1989 Reist
4,971,303 A * 11/1990 Lange et al. ..... 271/60
5,083,768 A * 1/1992 Ertavi et al. ..... 271/82
5,359,929 A 11/1994 Hansen
5,630,584 A * 5/1997 Seeber ..... 271/351
5,647,586 A * 7/1997 Novick et al. ..... 271/182
5,901,647 A 5/1999 Kohlmann
5,975,525 A * 11/1999 Haartmann et al. ..... 271/315

FOREIGN PATENT DOCUMENTS

| | | |
|---|---|---|
| DE | 195 09 947 | 9/1996 |
| DE | 195 25 169 | 9/1996 |
| GB | 2 168 687 A | 6/1986 |
| GB | 2 168 687 | 6/1986 |

* cited by examiner

*Primary Examiner*—Andrew H. Hirshfeld
*Assistant Examiner*—Darius N. Cone
(74) *Attorney, Agent, or Firm*—Cohen, Pontani, Lieberman & Pavane

(57) ABSTRACT

A paddle-wheel deliverer for a web-fed rotary printing machine is driven by its own, position-controlled motor so that the deliverer can be set up cost-effectively and the products are transferred reliably into the paddle wheel.

2 Claims, 2 Drawing Sheets

PADDLE-WHEEL DELIVERER

BACKGROUND OF THE INVENTION

1. Field of the Invention

The invention relates to a paddle-wheel deliverer for a web-fed rotary printing machine, having a driven paddle wheel, to which products are fed for subsequent deposit onto a transport belt.

2. Description of the Related Art

In folders it is known to use the drive which drives the folding cylinders to drive the paddle wheel as well. For this purpose, use is made of cylindrical gear train with gear stages, tooth coupling, cylindrical gears for a deliverer transport belt, lubrication systems for the gears, together with an enclosed oiling system, and other equipment. In addition, complicated adjustments and installation work are necessary. During operation, manual adjustments are necessary, for example for the changeover between uncollected and collected production. Overall, the paddle-wheel deliverer is expensive.

German reference DE 195 09 947 Al shows a folder in which individual functional units are driven by their own position-controlled motor in each case. Thus, for the paddle wheel of a delivery unit, a motor is provided which additionally drives a pull roll over which there run the belts by means of which the products are fed to the paddle wheel. In this case, it is disadvantageous that the phase angle of the paddle wheel in relation to the incoming products cannot be varied during operation.

SUMMARY OF THE INVENTION

The object of the invention is to provide a cost-effective paddle-wheel deliverer in which the products can be transferred reliably into the paddle wheel.

Pursuant to this object, and others which will become apparent hereafter, one aspect of the present invention resides in a paddle wheel deliverer having a driven paddle wheel, a transport belt, and a position-controlled motor drivingly connected to the paddle wheel.

In another embodiment of the invention the motor of the paddle wheel is also drivingly connected to the transport belt.

In still another embodiment the paddle wheel has a shaft and the transport belt has shaft. The motor and at least one of the shaft of the paddle wheel and the shaft of the transport belt each have a gear wheel over which an endless positive flexible drive means runs. The flexible drive means can be preferably either a toothed belt or a chain.

In still another embodiment of the invention the rotational angular position of the paddle wheel can be set or regulated depending upon the incoming products to be delivered.

The apparatus makes it possible to dispense with mechanical gear trains, gear stages, and toothed couplings. In addition, adjusting devices and associated actuating means and electrical monitoring devices are dispensed with. Complicated adjustments and installation work do not arise either. Overall, as a result the apparatus can be set up cost-effectively. The apparatus contains only a few wearing parts and can easily be protected against overloading.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
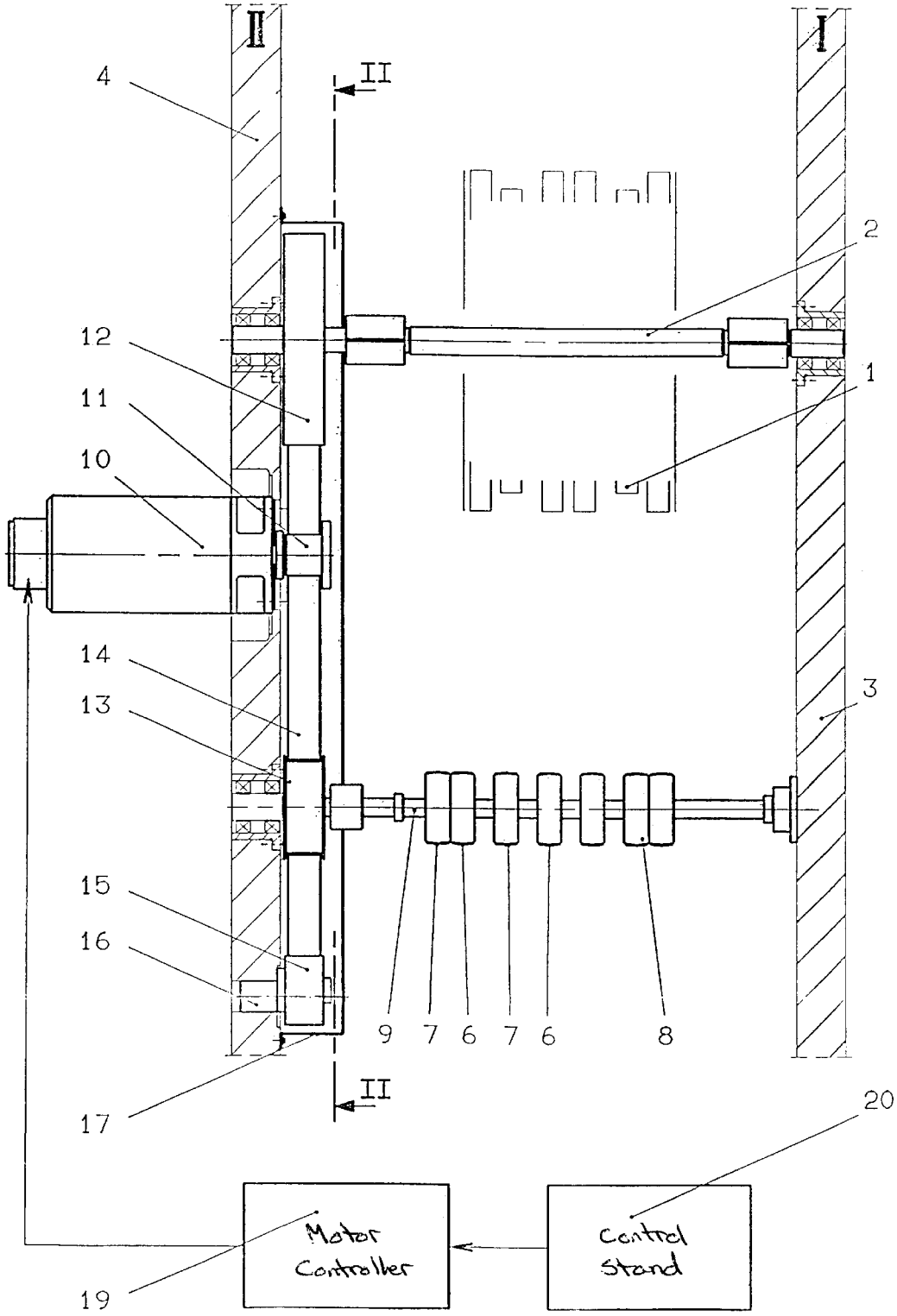
FIG. 1 schematically shows a paddle-wheel delivery.
Figure 2:
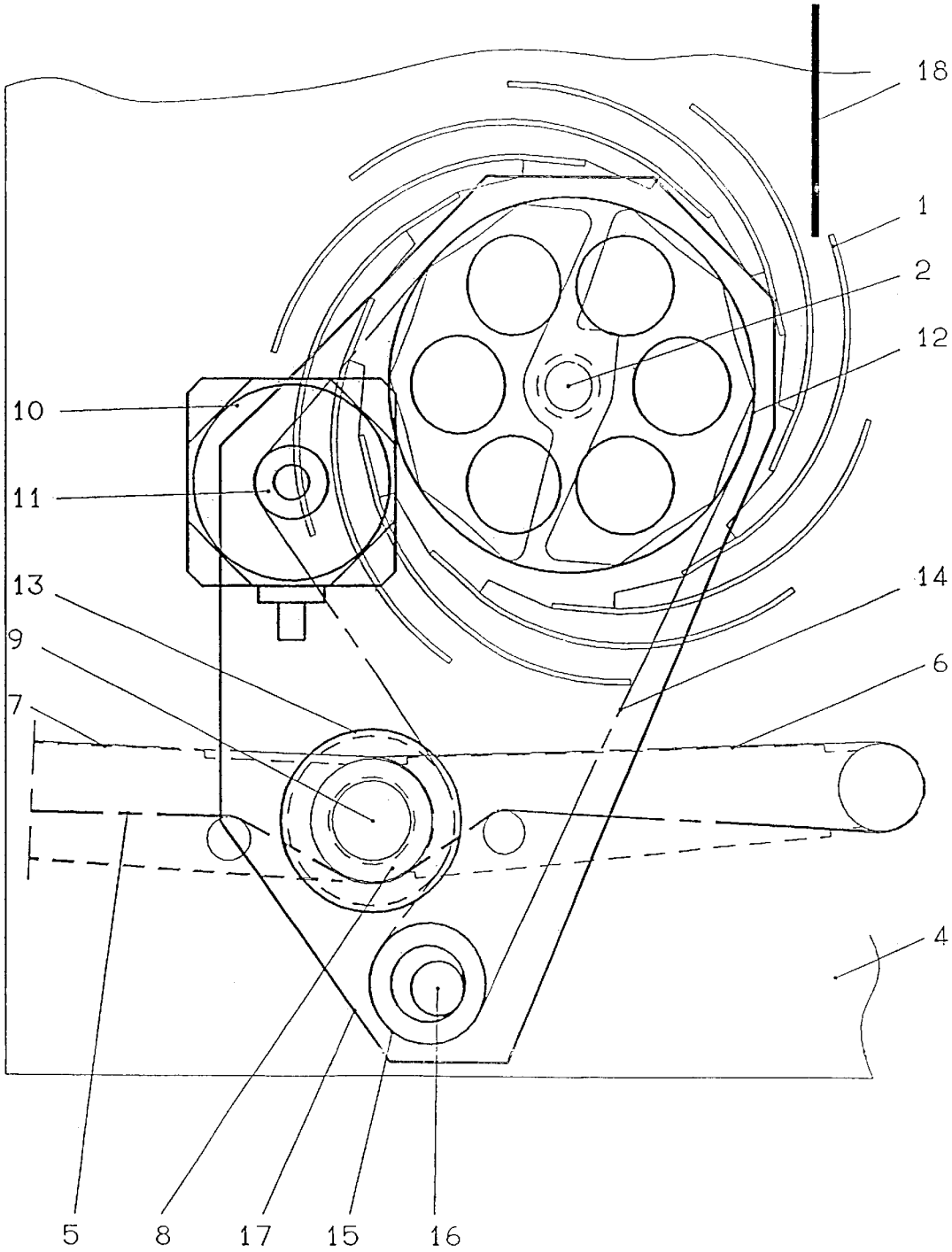
FIG. 2 schematically shows the section II-II according to FIG. 1 (with the paddle wheel and transport belt additionally shown by thin lines).

The paddle-wheel deliverer shown in FIG. 1 contains a paddle wheel 1, which is mounted with its shaft 2 in side walls 3, 4. Arranged under the paddle wheel 1 is a transport belt 5. In the illustrated embodiment, the belt is designed in two parts, with first belts 6 and second belts 7, each of which is led over belt rollers 8, which are fixed on a shaft 9 mounted in the side walls 3, 4.

The paddle wheel 1 and the transport belt 5 are driven by a motor 10, which is flange-mounted on the side wall 4 and, on its journal, bears a toothed pulley 11. Further toothed pulleys 12, 13 are borne by the shaft 2 of the paddle wheel 1 and the shaft 9 of the transport belt 5. Led over these toothed pulleys 11 to 13 is a double toothed belt 14, that is to say a toothed belt which bears teeth on both sides. A further toothed pulley 15 for tensioning the double toothed belt 14 is mounted on a pin 16 arranged so as to rotate in the side wall 4. The belt drive described is covered by a guard 17. Instead of the double toothed belt 14, use could also be made of a chain, the shafts 2 and 9 then bearing sprockets. It is also possible to drive from the motor 6 to the shaft 2 and the shaft 9 by means of cylindrical gears or, with the omission of gear wheels, to couple the motor 10 directly to the shaft 2 of the paddle wheel 1.

The motor 10 drives the paddle wheel 1 and the transport belt 5 by means of the double toothed belt 14. Conveyed in the pockets of the paddle wheel 1 are products 18 which, for example, are output by a folding-jaw cylinder, a cross-cutting device or a longitudinal folding device (none illustrated). As the paddle wheel 1 rotates further, the product is then deposited onto the transport belt 5 in an overlapping formation in a manner known per se.

The motor 10 is a position-controlled electric motor, that is to say its rotational angle is controlled by a motor controller 19 within the context of the machine control system. This control system also carries out the adjustment of the rotational angle position of the paddle wheel 1, that is to say its angular phase in relation to the incoming products 18. Likewise, the motor control system 19 is used to change over the rotational speed of the motor in the event of a changeover from collected to non-collected production and vice versa. This is carried out by means of entering commands at the control stand 20 of the rotary printing machine, which is appropriately connected to the motor controller 19. In a design variant, the motor controller 19 also contains rotational angle positions of the paddle wheel 1 in relation to the incoming products 18 stored as a function of the feed frequency (that is to say as a function of the production speed) of the products 18, by which means speed-dependent delays to the products fed to the paddle wheel 1 are counteracted by means of corresponding advancing or retarding of the paddle wheel 1. However, the angular position of the paddle wheel 1 can also be adjusted continuously by hand at the control stand 20 during production operation. Thanks to the indirect drive to the paddle wheel 1 via an external flexible drive, a beneficial torque transfer of the motor torque, that is to say an increase in the torque, is also possible. Furthermore, the individual electric-motor drive to the paddle wheel 1 can be safeguarded simply, by means of electrical load protection, against mechanical overloading with the associated risk of destruction of components of the paddle-wheel deliverer.

The invention is not limited by the embodiments described above which are presented as examples only but can be modified in various ways within the scope of protection defined by the appended patent claims.

We claim:

1. A paddle-wheel deliverer for a web-fed rotary printing machine, comprising:

a transport belt;

a driven paddle-wheel operative to rotate in a rotational direction so as to deposit products onto the transport belt;

a position-controlled motor drivingly connected to the paddle-wheel so as to rotate the paddle-wheel; and motor control means for controlling the motor so that rotational angle phase positions of the paddle-wheel in the rotational direction are controlled and for storing rotational angle positions of the paddle-wheel as a function of feed frequency of the products, which angle positions corresponding to the actual feed frequency of the motor control means are providable as settable desired values.

2. A paddle-wheel deliverer for a web-fed rotary printing machine, comprising:

a transport belt;

a driven paddle-wheel operative to rotate in a rotational direction so as to deposit products onto the transport belt;

a position-controlled motor drivingly connected to the paddle wheel so as to rotate the paddle-wheel;

motor control means for controlling rotational angle phase positions of the motor and the paddle-wheel in the rotational direction; and a control stand operatively connected to the motor control means so that the rotational angle positions of the paddle-wheel are settable in relation to incoming products.

* * * * *